US009007143B2

(12) United States Patent
Gilbert et al.

(10) Patent No.: US 9,007,143 B2
(45) Date of Patent: Apr. 14, 2015

(54) WIDE BANDWIDTH INTEGRATED 2X4 RF DIVIDER

(75) Inventors: Michael A. Gilbert, Santa Barbara, CA (US); Kevin C. Higgins, Goleta, CA (US); Andrew I. Hamill, Goleta, CA (US)

(73) Assignee: Toyon Research Corporation, Goleta, CA (US)

( * ) Notice: Subject to any disclaimer, the term of this patent is extended or adjusted under 35 U.S.C. 154(b) by 386 days.

(21) Appl. No.: 13/458,653

(22) Filed: Apr. 27, 2012

(65) Prior Publication Data

US 2012/0274415 A1 Nov. 1, 2012

Related U.S. Application Data

(60) Provisional application No. 61/480,260, filed on Apr. 28, 2011.

(51) Int. Cl.
*H01P 5/12* (2006.01)
*H01Q 21/24* (2006.01)

(52) U.S. Cl.
CPC . *H01Q 21/24* (2013.01); *H01P 5/12* (2013.01)

(58) Field of Classification Search
CPC ..... H01P 5/12; H01Q 21/24
USPC ..... 333/124–129, 132, 134, 136
See application file for complete search history.

(56) References Cited

U.S. PATENT DOCUMENTS

| | | | | |
|---|---|---|---|---|
| 3,325,587 | A | 6/1967 | Sontheimer | 174/72 |
| 3,508,171 | A | 4/1970 | Podell | 333/11 |
| 5,121,090 | A | 6/1992 | Garuts et al. | 333/124 |
| 6,388,543 | B1 * | 5/2002 | Molnar et al. | 333/172 |
| 6,486,749 | B1 * | 11/2002 | Tichauer et al. | 333/125 |
| 2013/0176084 | A1 * | 7/2013 | Bao | 333/126 |

OTHER PUBLICATIONS

Reich, et al., *Microwave Principles*, Van Nostrand Company, New York, NY, pp. 65-67 (1957).
Skolnik, *Radar Handbook*, 2nd edition, McGraw Hill, New York, NY, pp. 4.22-4.25 (1990).
Maas, *The RF and Microwave Circuit Design Cookbook*, Artech House, Boston, MA, pp. 44-45 (1998).
Barabas, "On an Ultrabroad-Band Hybrid Tee," *Proceedings of the IEEE on Microwave Theory and Techniques*, vol. MTT-27, No. 1, pp. 58-64 (1979).
IRE Standards on Antennas and Waveguides: Definitions for Waveguide Components, *Proceedings of the IRE*, vol. 43, pp. 1073-1074 (Sep. 1955).

* cited by examiner

*Primary Examiner* — Robert Pascal
*Assistant Examiner* — Kimberly Glenn
(74) *Attorney, Agent, or Firm* — Nixon & Vanderhye P.C.

(57) ABSTRACT

An improved implementation of a 2×4 divider formed from a bridge junction is described. The bridge junction uses parallel and series connections of coaxial lines to eliminate impedance transformers that are normally required in a 2×4 power divider. In a preferred embodiment, the bridge junction is comprised of UT-085 coax transmission lines, 20 gauge twin lead wire and SB-805-61 ferrite beads with ½ turn windings to provide a wide bandwidth, compact, high power and rugged arrangement.

20 Claims, 7 Drawing Sheets

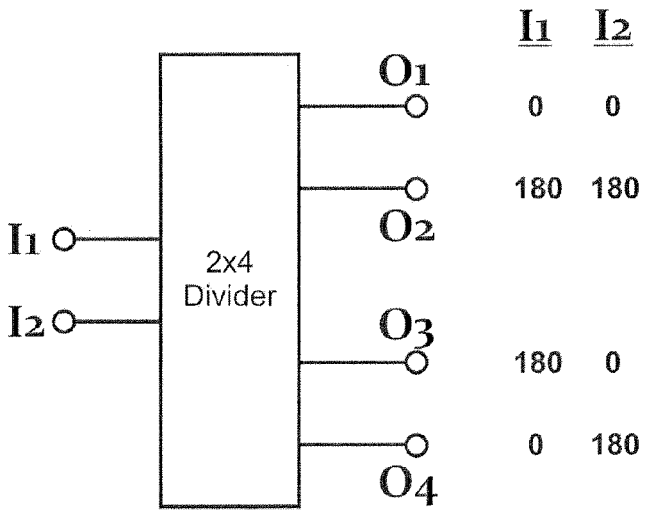
Figure 1: 2x4 Divider Block Diagram
(PRIOR ART)
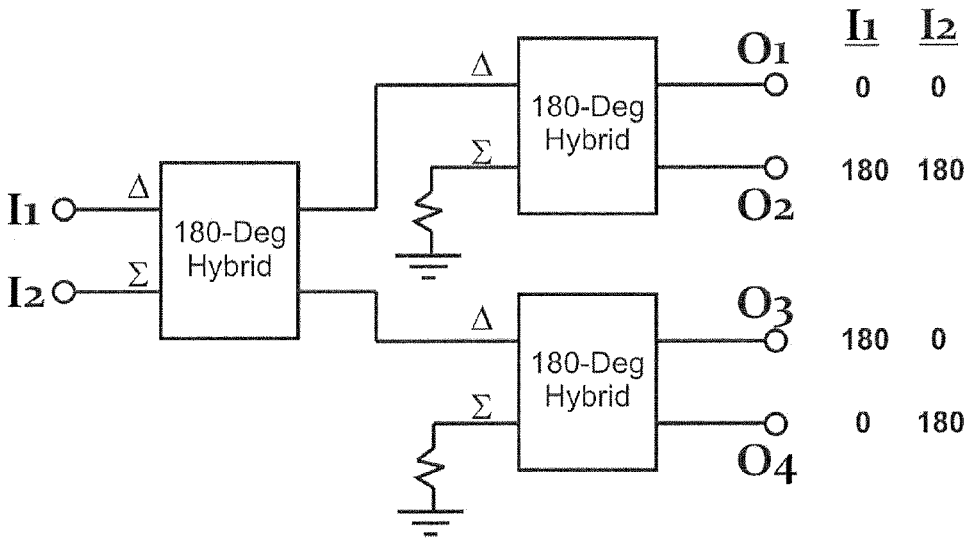
Figure 2: 2x4 Divider using 180-degree Hybrids
(PRIOR ART)

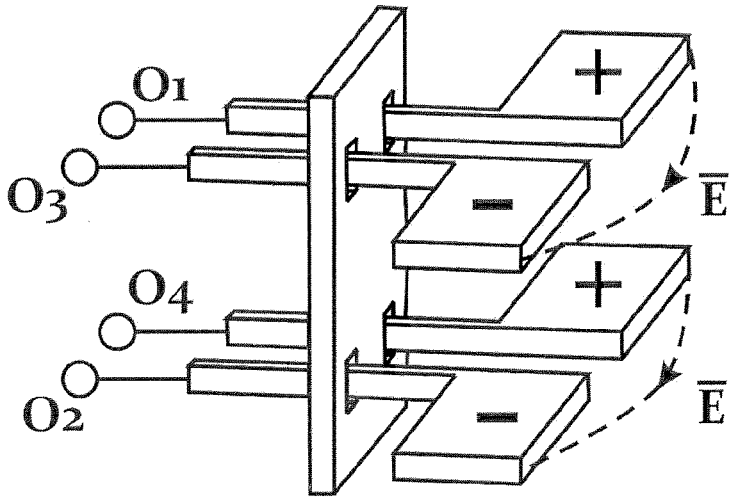
Figure 3: Horizontally Polarized Antenna
(PRIOR ART)
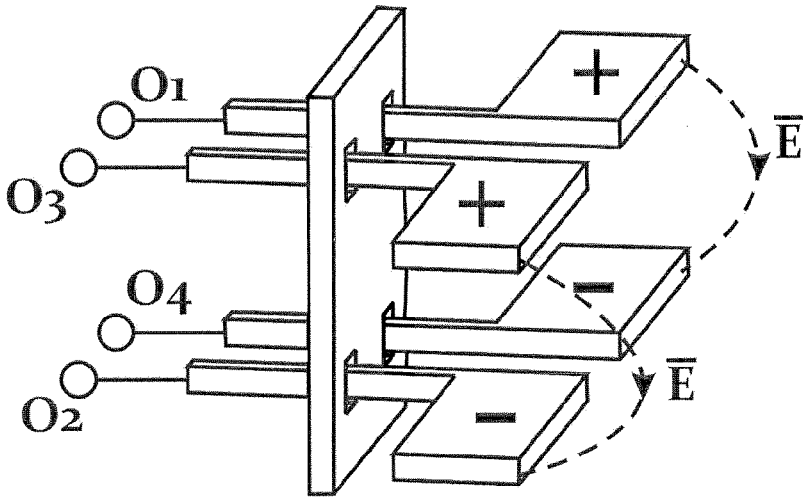
Figure 4: Vertically Polarized Antenna
(PRIOR ART)

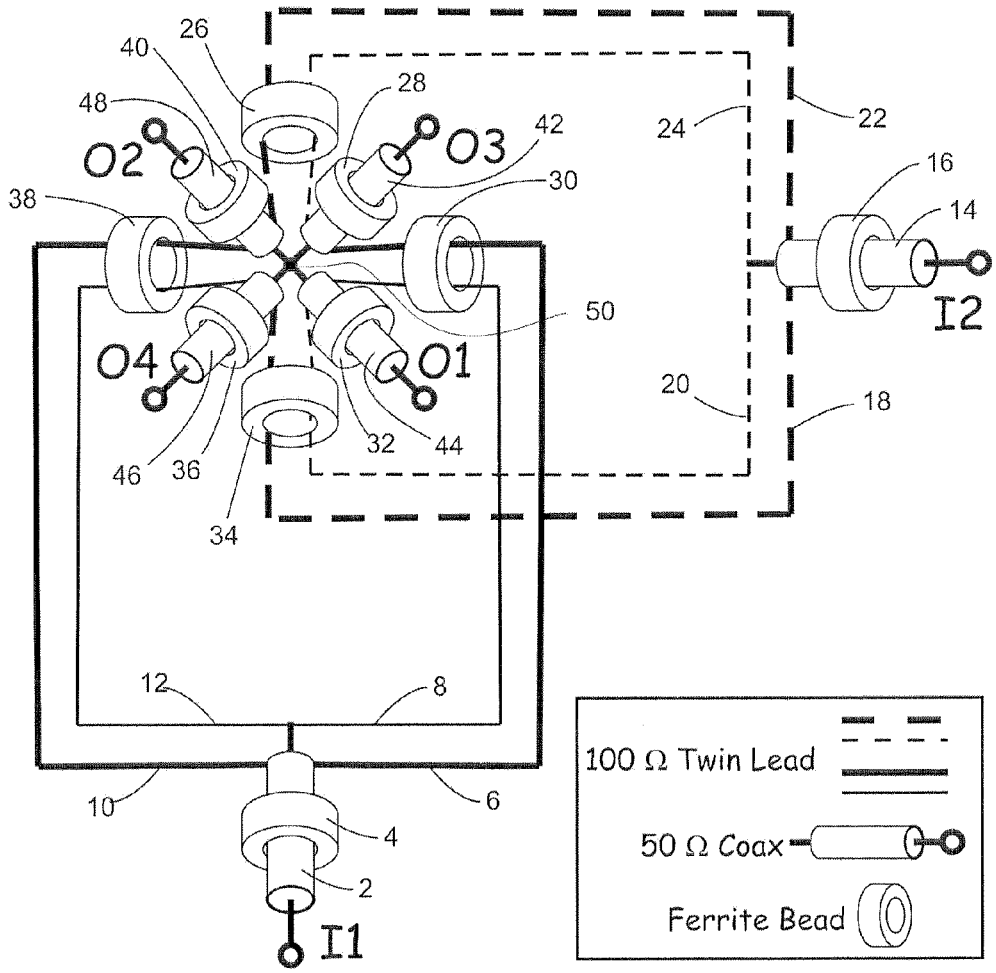
Figure 5: Exemplary Embodiment

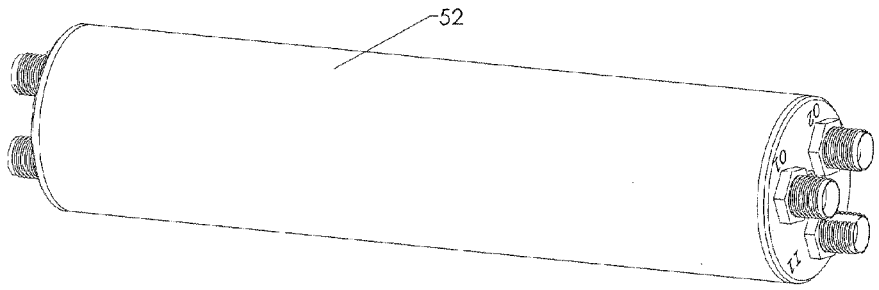
Figure 6: Metal Enclosure
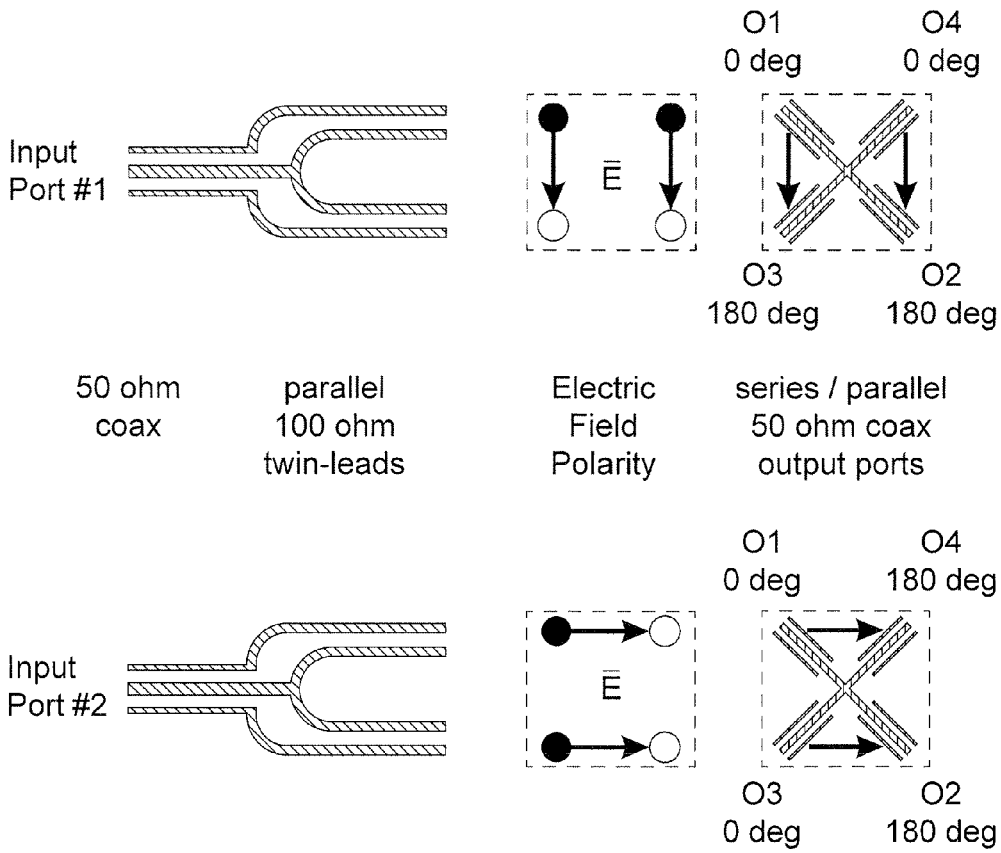
Figure 7: Conceptual Drawing of Exemplary Embodiment

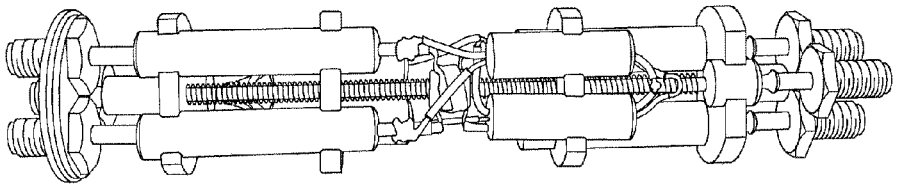
Figure 8: Exemplary Embodiment without Metal Enclosure
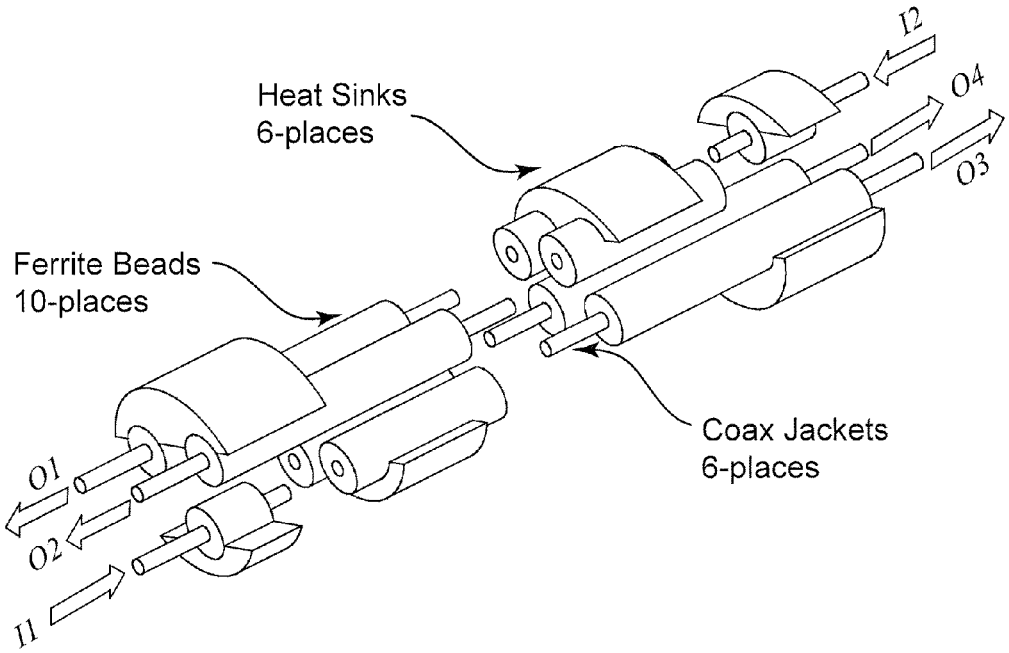
I1, I2 = Inputs
01, 02, 03, 04 = Outputs
Figure 9: Exemplary Embodiment with Heat Sinks

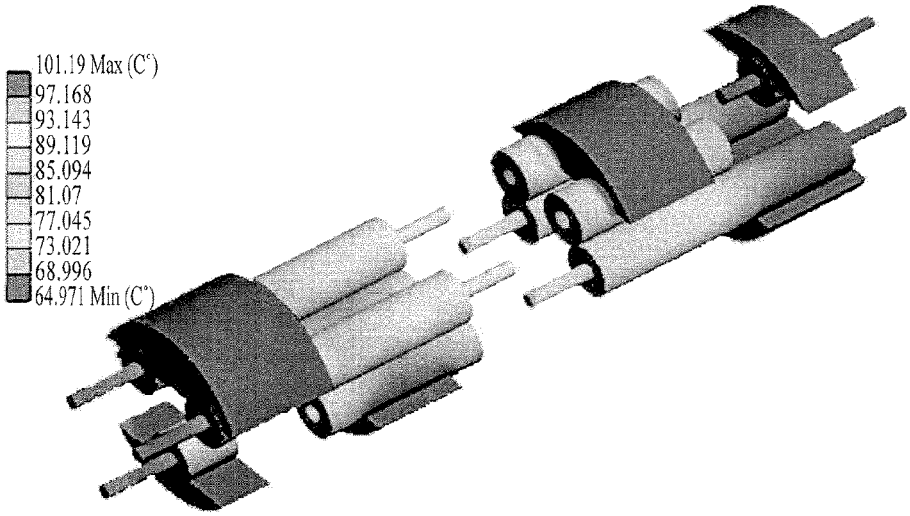
Figure 10: Locating candidate heat sink location with CAD tools
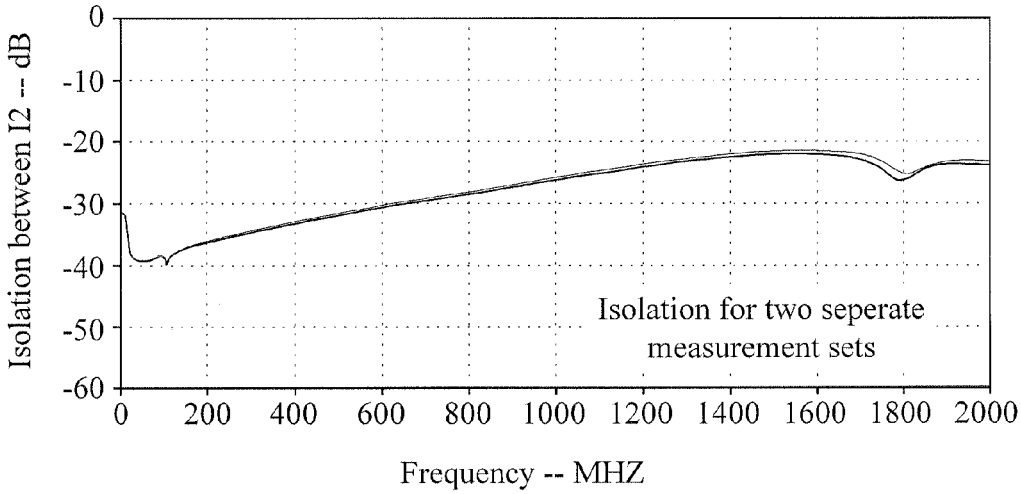
Figure 11: Wideband Isolation of Input Ports

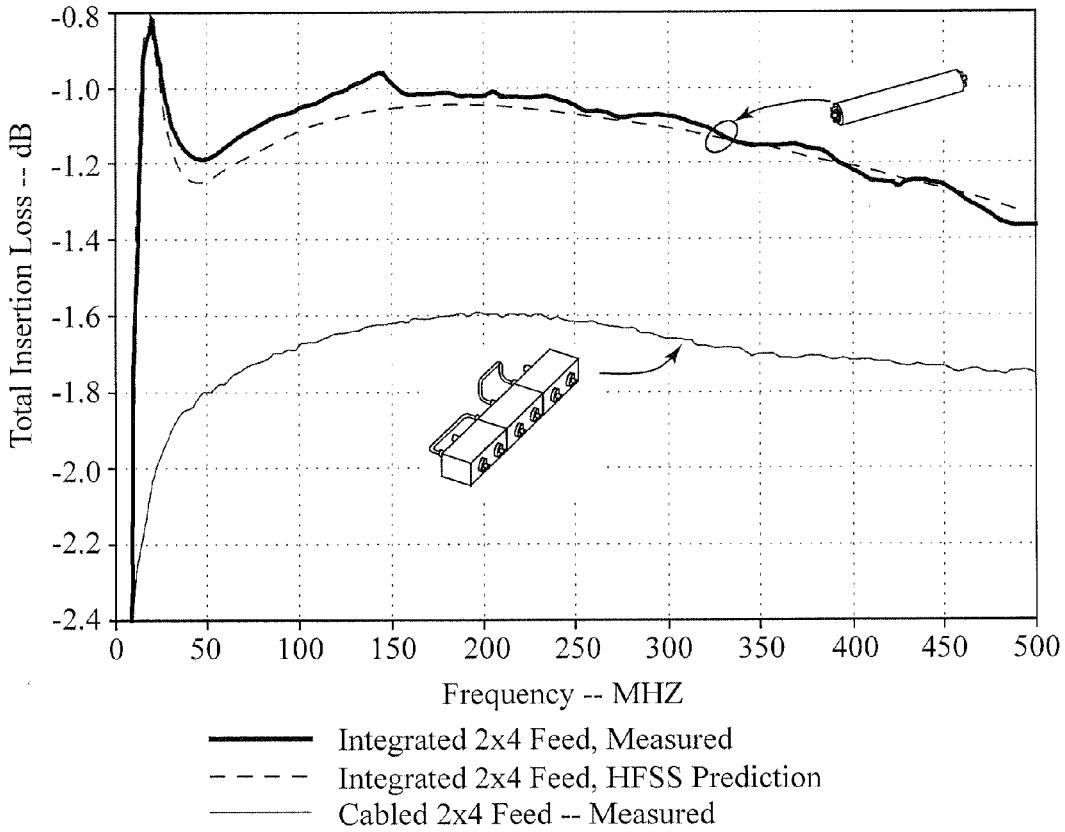
Figure 12: Insertion Loss of Exemplary Embodiment vs. Current Technology using 180° Hybrids

WIDE BANDWIDTH INTEGRATED 2X4 RF DIVIDER

RELATED APPLICATIONS

This non-provisional application claims priority rights pursuant to 35 U.S.C. §119(e) based on U.S. Provisional Application Ser. No. 61/480,260, filed Apr. 28, 2011, the entire content of which is hereby incorporated by reference.

BACKGROUND

1. Technical Field

The present application relates to the field of radio frequency (RF) power dividers and more particularly relates to a class of 2×4 power dividers that produce two pairs of differential unbalanced outputs from two unbalanced inputs.

2. Background

The general input-output relationship of a 2×4 divider, which has two input ports labeled I1 and I2, and four output ports labeled O1, O2, O3, and O4, is shown in FIG. 1. The relative phase of the ports is indicated by FIG. 1 and in the following:

| | Phase (deg) | | | |
|---|---|---|---|---|
| Port | O1 | O2 | O3 | O4 |
| I1 | 0 | 180 | 180 | 0 |
| I2 | 0 | 180 | 0 | 180 |

In the current state of the art, 2×4 dividers are built using a corporate connection of three 180-degree hybrids as depicted in FIG. 2. The general operation and design of 180-degree hybrids is described in the open literature. See, for example, the *IRE Standards on Antennas and Waveguides* (1955), *Microwave Principles* by Reich et al. (1957), *Radar Handbook* by Skolnik (1990), *The RF and Microwave Circuit Design Cookbook* by Maas (1998), and "On an Ultrabroad-Band Hybrid Tee" by Barabas (1979), and a few specific designs that are described by U.S. Pat. No. 3,325,587 (1967), U.S. Pat. No. 3,508,171 (1970), and U.S. Pat. No. 5,121,090 (1992).

The corporate arrangement of 180-degree hybrids shown in FIG. 2 requires two interconnecting transmission lines, two resistive loads, and normally requires two impedance transformers to return the impedance to 50-ohms between the hybrids. Such a 2×4 divider can be utilized to generate dual-linear polarization from a four port antenna as depicted by FIGS. 3 and 4. Dual-linear polarized antennas simultaneously support two orthogonal linear polarizations.

Power dividers comprising 180-degree hybrids, resistive loads, and impedance transformers tend to be large, especially at low frequencies; partially due to the fact that 180-degree hybrids are bulky devices. Moreover, such 2×4 dividers have high insertion losses and the two resistive loads do not serve any purpose for applications where the divider feeds into a symmetric device. Hence there is a need to reduce the size and insertion loss of the 2×4 divider by eliminating the interconnecting transmission lines, the resistive loads, and the impedance transformers.

BRIEF SUMMARY

We define a 2×4 divider as an RF power divider having exactly two 50-ohm coaxial input ports (I1 and I2) and exactly four 50-ohm coaxial output ports (O1, O2, O3, and O4) such that each of the two input ports divides the power about equally between the four output ports with two of the output ports being in-phase and two of the output ports being 180-degrees out of phase, and further that the two input ports are isolated, and even further that the phase of two of the output ports remains unchanged when switching input ports while the phase of the other two output ports changes by 180-degrees. This phase arrangement at the output ports is depicted by FIG. 1. Although the ports of the 2×4 divider are labeled as input (I1 and I2) and output (O1, O2, O3, O4), the roles can be reversed.

Our exemplary embodiment utilizes a single 2×4 transmission line bridge junction to integrate the 2×4 divider into a small package without any 180-degree hybrids, interconnecting transmission lines, resistive terminations, or impedance transformers. This bridge junction divides the power from each input port directly into four paths with a parallel and series connection of coaxial transmission lines. The exemplary embodiment is useful for applications requiring a wide bandwidth 2×4 divider in a small package. One preferred use for the 2×4 divider is as an antenna feed to generate dual-linear polarization from a pair of dipole antennas, as well as other four-port antenna systems.

BRIEF DESCRIPTION OF THE DRAWINGS

FIG. 1 shows a block diagram of a 2×4 divider and the required phase at the four output ports when driving each of the two input ports.

FIG. 2 shows a schematic for a prior art 2×4 divider assembled from a corporate connection of three 180-degree hybrids.

FIG. 3 illustrates the use of a 2×4 divider to generate horizontal polarization from a dual-linearly polarized antenna.

FIG. 4 illustrates the use of a 2×4 divider to generate vertical polarization from a dual-linearly polarized antenna.

FIG. 5 shows a schematic for the exemplary embodiment using a transmission line bridge junction.

FIG. 6 shows one possible metal enclosure configuration to house the exemplary embodiment.

FIG. 7 shows the conceptual drawing of the exemplary embodiment.

FIG. 8 shows an assembled system of the exemplary embodiment without a metal enclosure.

FIG. 9 shows an exemplary embodiment with heat sinks for more power-demanding applications.

FIG. 10 shows an exemplary embodiment with a computer-aided application that is used to determine the locations where heat sinks may be necessary.

FIG. 11 demonstrates the wideband isolation performance of the exemplary embodiment.

FIG. 12 demonstrates the improved insertion loss of the exemplary embodiment over the current state of the art that uses 180° hybrids.

DETAILED DESCRIPTION OF EXEMPLARY EMBODIMENTS

A preferred embodiment of our 2×4 divider is illustrated in FIG. 5. At the 2×4 divider input, I1, the RF signal enters the 2×4 divider via a 50-ohm UT-085 semi-rigid coaxial transmission line 2 which is passed thru a slide fitting SB-801-61 ferrite bead 4 and split into two twin-lead transmission lines formed by the 20-gauge pair of wires 6 and 8 and the 20-gauge pair of wires 10 and 12. The insulation is removed from wire 6 and from wire 10 to fit within SB-801-61 ferrite beads 30 and 38 and also to form a 100-ohm transmission line within those ferrite beads. Since the pair of 100-ohm twin-lead transmission lines are connected in parallel, together they present a 50-ohm impedance match to the input coaxial transmission line. It is important to minimize the lengths of wire that are located outside the ferrite beads, since those lengths of wire contribute spurious reactance that can limit the upper frequency range of the 2×4 divider.

After passing thru ferrite beads 30 and 38, the wires 6, 8, 10, 12 are soldered to the outer jackets of 50-ohm UT-085 coaxial transmission lines 42, 44, 46, and 48 which then lead to the four output ports (O1, O2, O3, and O4) of the 2×4 divider. The center conductor of coaxial transmission lines 42, 44, 46, and 48 are soldered together at hub 50. These four coaxial transmission lines 42, 44, 46 and 48 and hub 50 form a bridge junction that divides the input power entering port I1 equally in amplitude between output ports O1, O2, O3, and O4 and with the desired phase progression 0, 180, 180, 0 defined in FIG. 1 for input I1. It is important to note that at the bridge junction, the two twin-lead transmission lines present 50-ohms impedance (two 100-ohm twin-leads in parallel) and also that the four coaxial transmission lines (two series connected pairs in parallel) also present 50-ohms impedance. This natural 50-ohm to 50-ohm impedance match at the bridge junction eliminates the need for impedance matching networks normally required in a power divider.

The signal entering the 2×4 divider from input port I2 follows similar paths as described above for 2×4 divider input port I1, excepting that the order of connections to the outer jackets of coaxial transmission lines 42, 44, 46, and 48 are rotated so as to achieve the desired phase progression 0, 180, 0, 180 defined in FIG. 1 for input I2.

The outer jackets of all six coaxial transmission lines are connected together by a common ground which could be provided by a metal enclosure 52 such as that shown in FIG. 6. The purpose of the ferrite beads 4, 16, 28, 32, 36, and 40 on coaxial transmission lines 2, 14, 42, 44, 46, and 48 is to choke undesired currents off the outer jackets of the coaxial transmission lines as they propagate toward the common ground.

The purpose of ferrite beads 26, 30, 34, and 38 is to isolate input I1 from input I2 which would otherwise present a short circuit. For example, note that wire 12 is connected to the center conductor of coaxial transmission line 2 and that wire 12 also connects to wire 18 at the bridge junction and note that wire 18 connects to the outer jacket of coaxial transmission line 14 which is shorted to the outer jacket of coaxial transmission line 2 thru the metal housing 52 (shown in FIG. 6). Hence at DC the center conductor and jacket of coaxial transmission line 2 are shorted together. The ferrite beads 26, 30, 34, and 38 introduce high impedances that eliminate the short-circuit paths between I1 and I2 at radio frequencies.

Note that all ten ferrite beads 4, 16, 26, 28, 30, 32, 34, 36, 38, and 40 use ½ turn windings. The use of ½ turn windings limits the magnetic flux density and enables the 2×4 divider to handle high power levels while maintaining levels of magnetic flux density well below the saturation level for the ferrite beads.

FIG. 7 illustrates an underlying concept of the exemplary embodiment. From the 50-ohm coaxial transmission line at the first input, I1, the signal is split between a pair of 100-ohm twin-lead transmission lines, which are then positioned as shown to create a vertically polarized electric field vector, E. This vertically polarized field is probed at the 45-degree angles by four coaxial transmission lines, resulting in the desired phase (0, 180, 180, and 0) at output ports O1, O2, O3, and O4. A 50-ohm impedance is maintained across both transitions: input coax to pair of twin-leads, and pair of twin-leads to four coaxial outputs; which eliminates the need for impedance transformers. Similarly, a signal from the second input port, I2, generates a horizontally polarized electric field vector, E, and results in the desired phase (0, 180, 0, and 180) at output ports O1, O2, O3, and O4.

FIG. 8 shows an exemplary embodiment with a single bridge junction at the center using coaxial transmission lines, ferrite beads and wires. The exemplary embodiment can be mounted inside a cylindrical outer metal housing 52 as shown in FIG. 6.

High-power applications may require the placement of heat sinks at appropriate locations within the bridge junction assembly that maximizes heat transfer and dissipation. Such an exemplary embodiment is shown in FIG. 9. Judicious use of heat sinks may be necessary to maintain performance. As illustrated in FIG. 10, computer-aided design tools may be used to determine the specific 'hot spots' that require heat sinks, thereby minimizing loss.

The wideband isolation performance between the two input ports is shown in FIG. 11 for the preferred embodiment using a single junction bridge. Isolation between input port I1 and I2 is better than 20 dB between DC and at least 2 GHz.

The insertion loss performance of the exemplary embodiment being used as an antenna feed vs. that of a 2×4 divider using three cabled 180° hybrids is shown in FIG. 12. Relative to a specific 2×4 divider using 180° hybrids, the insertion loss improvement is approximately 0.3 dB over a wide bandwidth. The difference in insertion loss may vary at different frequencies. The performance of the exemplary embodiment at lower frequencies can be further improved by using longer ferrites.

Although the 2×4 divider has been described with respect to a preferred embodiment thereof, it will be obvious to those skilled in the art that many modifications, additions, and deletions may be made therein without departing from the scope and spirit of the preferred embodiment as set forth in the following claims.

What is claimed is:

1. A 2×4 RF power divider comprising a radio-frequency transmission line bridge junction having two 50-ohm input ports and four 50-ohm output ports, said ports being interconnected by transmission line structures configured to cause:

(a) said input ports to be isolated from each other, (b) input power to each one of said input ports to be divided equally about said output ports with two of the output ports being in-phase and two of the output ports being 180 degrees out-of-phase relative to the in-phase output ports, and (c) the relative phases of two of the output ports to remain unchanged while the relative phases of the remaining two output ports change by 180 degrees when a different one of the two input ports is used.

2. The 2×4 RF power divider of claim 1, wherein the input and output ports of the bridge junction comprise 50-ohm transmission lines each having a center conductor and an outer jacket, and wherein the center conductors of each of the transmission lines corresponding to said output ports are connected together at a single hub.

3. The 2×4 RF power divider of claim 2, wherein the bridge junction is devoid of 180-degree hybrid couplers.

4. The 2×4 RF power divider of claim 3, wherein the bridge junction is devoid of impedance transformers.

5. The 2×4 RF power divider of claim 2, further comprising two pairs of 100-ohm twin-lead transmission lines wherein each one of said pairs of 100-ohm transmission lines is connected in parallel to one of the transmission lines corresponding to said input ports and to each of the outer jackets of said transmission lines corresponding to said output ports.

6. The 2×4 RF power divider of claim 5, wherein only one of the lead wires for each of the 100-ohm twin-lead transmission lines is insulated.

7. The 2×4 RF power divider of claim 5, further comprising a plurality of ferrite beads wherein each one of said 50-ohm transmission lines and said 100-ohm transmission lines resides within one of said ferrite beads.

8. The 2×4 RF power divider of claim 7, wherein said ferrite beads have ½-turn windings.

9. The 2×4 RF power divider of claim 7, wherein said junction bridge further comprises a metal enclosure that serves as a common ground for the outer jackets of all the 50-ohm transmission lines.

10. The 2×4 RF power divider of claim 7, further comprising a set of heat sinks wherein each one of said heat sinks is attached to a selected subset of said ferrite beads, thereby enabling higher powered operation.

11. A 2×4 RF power divider transmission line bridge junction, said divider comprising:

a first input port connected in parallel to first ends of first and second twin lead transmission lines;

a second input port connected in parallel to first ends of third and fourth twin lead transmission lines;

four output ports having commonly connected first conductors, said output ports having second conductors respectively connected to second ends of said first and second twin lead transmission lines in a first ordered sequence, and said second conductors of said output ports also being respectively connected to second ends of said third and fourth twin lead transmission lines in a second ordered sequence different from said first ordered sequence.

12. The 2×4 RF power divider of claim 11, wherein said first and second input ports comprise 50-ohm coaxial transmission lines.

13. The 2×4 RF power divider of claim 12, wherein said four output ports comprise 50-ohm coaxial transmission lines.

14. The 2×4 RF power divider of claim 13, wherein said output port first conductors comprise center conductors of said four output port coaxial transmission lines which are conductively connected together at one junction which is symmetrically located with respect to each of the output ports.

15. The 2×4 RF power divider of claim 11, wherein only one side of each twin lead transmission line is insulated.

16. The 2×4 RF power divider of claim 13, further comprising a ferrite bead surrounding each of the twin lead transmission lines and each of the coaxial transmission lines.

17. The 2×4 RF power divider of claim 16, further comprising a plurality of heat sinks, each said heat sink being in thermal contact with a respectively corresponding subset of said ferrite beads.

18. The 2×4 RF power divider of claim 12, further comprising a metal enclosure that serves as a common ground for an outer conductor of all the coaxial transmission lines.

19. The 2×4 RF power divider of claim 18, further comprising:

a ferrite bead surrounding each of the twin lead transmission lines and each of the coaxial transmission lines; and a plurality of heat sinks, each said heat sink being in thermal contact with a respectively corresponding subset of said ferrite beads and in thermal contact with said metal enclosure.

20. The 2×4 RF power divider of claim 11, wherein each of said parallel-connected twin lead transmission lines has a nominal 100 ohm characteristic transmission line impedance and said input and output ports all comprise coaxial transmission lines having a nominal 50 ohm characteristic transmission line impedance.

* * * * *